United States Patent [19]

Knoke et al.

[11] 4,430,372

[45] Feb. 7, 1984

[54] NON-WOVEN FABRIC WITH IMPROVED HOT-PRESS PROPERTIES AND METHOD FOR MANUFACTURING SAME

[75] Inventors: Jürgen Knoke, Weinheim; Holger Buchwald, Hemsbach; Jürgen Fehlhaber, Gorxheimertal, all of Fed. Rep. of Germany

[73] Assignee: Firma Carl Freudenberg, Weinheim, Fed. Rep. of Germany

[21] Appl. No.: 387,612

[22] Filed: Jun. 11, 1982

[30] Foreign Application Priority Data

Nov. 13, 1981 [DE] Fed. Rep. of Germany ..... 3145137

[51] Int. Cl.[3] ..... B05D 1/14

[52] U.S. Cl. ..... 428/90; 427/200; 427/206; 428/95; 428/288

[58] Field of Search ..... 428/90, 95, 288; 427/200, 206

[56] References Cited

U.S. PATENT DOCUMENTS

| | | | |
|---|---|---|---|
| 3,459,579 | 8/1969 | Newman | 428/90 |
| 3,903,331 | 9/1975 | Klein | 428/90 |
| 3,993,806 | 11/1976 | Athey | 428/90 |

*Primary Examiner*—Marion McCamish

*Attorney, Agent, or Firm*—Kenyon & Kenyon

[57] ABSTRACT

Described herein is a nonwoven fabric with improved hot-press properties and a method for manufacturing the same, consisting of natural and/or synthetic fibers which are united to form an open thread structure and are coated entirely or partially with a coating of an elastic bonding agent, where the ends of short fibers protruding beyond the surface of the nonwoven fabric in nap-fashion on one or both sides are bound into the coating. The short fibers are introduced into the thread structure in an electrostatic field and may be distributed regularly or irregularly.

10 Claims, 1 Drawing Figure

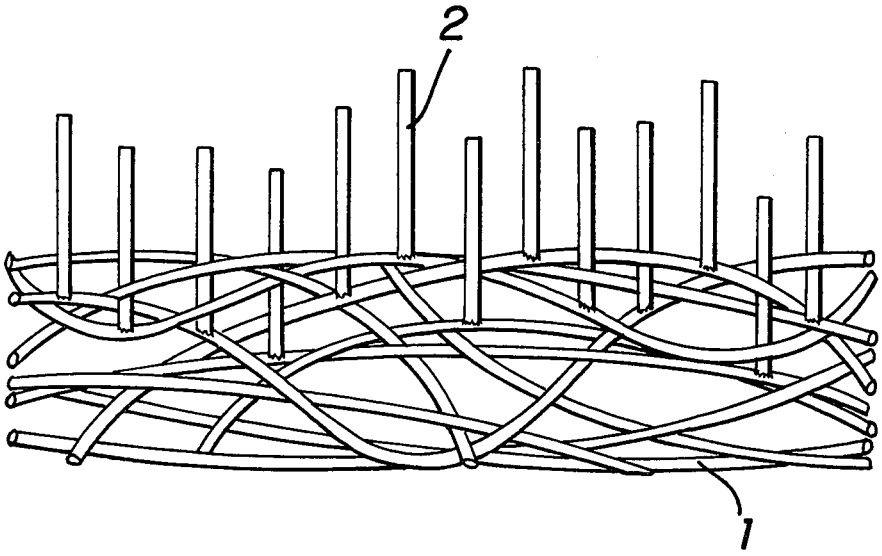
2
1

NON-WOVEN FABRIC WITH IMPROVED HOT-PRESS PROPERTIES AND METHOD FOR MANUFACTURING SAME

BACKGROUND OF THE INVENTION

The present invention relates to a nonwoven fabric of natural and/or synthetic threads with improved hot-press properties.

Nonwoven fabrics of this type are textile products which are finding increasing acceptance in the manufacturing of insert materials as well as in the manufacture of bed linen, curtains, drapes, towels, napkins and the like. In these applications, the nonwoven fabrics are distinguished by their excellent properties with respect to use and cleaning. However, to obtain the necessary cohesion of the fibers in these nonwoven fabrics, the embedment of a bonding agent is required. This impairs the appearance of the materials made therefrom and, particularly, impairs the ability of the materials to be hot-pressed, especially if a soft bonding agent has been used to obtain a textile-like feel.

SUMMARY OF THE INVENTION

It is an object of the present invention to provide a nonwoven fabric which is suitable for the applications mentioned and which is distinguished, as compared to known nonwoven fabrics, by improved hot-press properties while having equivalent use properties and cost-effective producibility.

Another object of the present invention is to provide a process for the manufacture of nonwoven fabrics having good hot-pressing properties, particularly where a soft bonding agent is employed.

According to the present invention, a nonwoven fabric is provided in which the threads of the nonwoven fabric are united to form an open thread structure and are coated, either fully or partially, with a coating of an elastic bonding agent, and wherein the ends of short fibers extending beyond the surface of the nonwoven fabric on one or both sides in nap-fashion are bound into the coating.

Krema, Handbuch der Textilverbundstoffe, Deutscher Fachverlag GmbH Frankfurt/Main, 1970, refers on pages 191 and 192 to the electrostatic coating of a base material with short fibers. The base material has a continuous adhesive layer and the loosely deposited short fibers extend accordingly, if they are of equal length, from the surface of the base material in brush-fashion. The interaction between the environment and the base material as well as its properties can be adversely affected considerably by the adhesive layer.

In the nonwoven fabric of the present invention, on the other hand, the threads are united to form an open thread structure and they themselves are coated entirely or partially with a coating of an elastic bonding agent, into which the ends of loosely deposited short fibers are unilaterally bound. The length of the short fibers is made so that they protrude beyond the surface of the nonwoven fabric. Depending on how the short fibers are anchored, however, they do not protrude beyond the surface of the nonwoven fabric by the same amount, even if they have the same length. Rather, the nap formed by the short fibers is characterized by considerable, regularly-repeated irregularities. The overall impression of the nonwoven fabric as a textile is thereby enhanced considerably.

The short fibers are bound at one end into the elastic bonding agent layer and have an elastic behavior even if the short fibers consist of an inelastic material, for example, of polyamide 6, polyamide 66, polyester, polyacryl, staple fiber or cotton. The short fibers can bend over laterally due to this elasticity under the action of a lateral force, for example, by a flatiron, in an elastically resilient manner, and can straighten up again when the load is released. During the bending-over, the elastic bonding-agent particles sticking to the threads of the nonwoven fabric are covered by the short fibers, whereby the flatiron can readily slide over these areas.

Since the short fibers are connected to the threads of the nonwoven fabric only by an end face, there are no limitations of any kind as to the lateral bendability. For this reason, the nonwoven fabric of the present invention has a nondirectional behavior when being ironed, which is of great advantage especially in designs with directional stiffening, such as is frequently desired, for example, for apparel inserts.

The short fibers can extend from the surface of the nonwoven fabric on one or both sides. With a length of 0.3 to 3 mm, the titer of the short fibers is 0.5 to 7 dtex and, preferably, with a length of 0.5 to 1 mm, the titer is 1.3 to 3.3 dtex. The ratio of the length of the short fibers to the thickness of the nonwoven fabric should be about 2:1 to 7:1.

Surprisingly, it is not absolutely necessary that the nonwoven fabric be coated continuously with short fibers. In many cases it is sufficient if the bonding agent and the short fibers are arranged in closely adjacent areas distributed in pattern-fashion. The zones between such areas can be utilized in this case, for example, to achieve decorative effects.

The threads of the nonwoven fabric may be arranged in several layers which are arranged on top of each other and offset relative to each other. The apparent fissures in the surface of the nap consisting of short fibers are distinctly enhanced in this manner.

The bonding agent can envelop the fibers in film-fashion and the nonwoven fabric is distinguished in this case by particularly great softness and drapability. The short fibers in this case are distributed relatively uniformly over the entire surface.

The mentioned effects are distinctly enhanced with increasing reduction of the layer thickness of the bonding agent. Particularly good results are achieved through the use of a bonding agent which can be cross-linked by polymerization and which permits a bonding agent film of the smallest possible thickness on the surfaces of the fibers.

Greater strength of the nonwoven fabric can be obtained through the use of bonding agents which are concentrated in laminar fashion in the vicinity of the thread crossings. In such embodiments, the loosely deposited fibers also are concentrated in the vicinity of these laminations, and the fibers penetrate the surface of the nonwoven fabric in cluster-fashion in the mentioned areas. Nonwoven fabrics of this kind are highly suitable as table and bed linen or for the manufacture of towels. They also have great abrasion resistance.

In cases where the bonding agent is distributed on the nonwoven fabric in pattern-fashion, for example, by printing, it has been found advantageous to use circular areas which have a diameter, for example, of about 1 to 3 mm as well as a mutual spacing which corresponds approximately to the diameter of the circular areas. In spite of the irregularity actually present, such a nonwoven fabric appears especially uniform and textile-like.

The manufacture of nonwoven fabrics containing a soft bonding agent but which are distinguished by good hot-pressing properties has been difficult employing known methods. According to the present invention, this problem is solved by the provision of a process wherein (a) the artificial and/or natural fibers are united to form a planar structure and are joined together, where the planar structure is impregnated or printed with an elastic bonding agent; (b) short fibers are sprinkled onto the planar structure on one or both sides in an electrostatic field; and (c) the bonding agent is then solidified and cross-linked.

The method of the present invention can be performed without particular difficulties on a large technical scale. The planar structure of fibers can be presolidified before it is impregnated or printed with the bonding agent, and there are no limitations of any kind with respect to the specific choice of available methods for achieving such presolidification. The presolidification can be accomplished, for example, by cementing and/or welding the fibers together.

The bonding agent can be solidified and cross-linked by a final heat treatment and in this case it is advisable to embed heat-shrinking or heat-expanding threads and to excite them to shrink or expand during the final heat treatment in order to bring about a wrinkling of the threads of the planar structure. This wrinkling, coupled with the irregularities formed by the short fibers which penetrate the planar structure in different lengths, gives the planar structure obtained an extremely attractive appearance which no longer resembles nonwoven material.

Besides good hot-pressing properties, the nonwoven fabric of the present invention is distinguished by improved dry-cleanability and improved washability and abrasion resistance. The feel of the fabric is fuller and bulkier and the thermal insulation and the moisture absorptivity are improved while the air permeability is equivalent to designs according to the state of the art. The planar structure used may consist of staple or endless fibers and be obtained by a dry or wet process.

BRIEF DESCRIPTION OF THE FIGURE

In the attached drawing, a nonwoven fabric according to the present invention is shown schematically in a longitudinal cross section.

DETAILED DESCRIPTION OF THE INVENTION

The nonwoven fabric shown in the drawing has one layer and consists of threads 1 which are united to form an open thread structure. The threads are continuously impregnated with a bonding agent film (not shown) into which the ends of the perpendicularly deposited short fibers 2 are bound. The short fibers 2 have the same length among themselves but, due to the difference in their attachment position at the individual threads, they protrude beyond the surface of the nonwoven fabric at different heights, whereby the fabric is given a regular-/irregular textile-like appearance. Due to their own elasticity and the elasticity of the bonding agent, the short fibers can be bent elastically sideways and straighten themselves up again automatically when the load is released. Thus, the short fibers act as spacers and prevent direct mechanical contact between the flatiron and the surface of the threads 1 coated with the bonding agent. Instead of one-sided deposition of fibers, as shown in the drawing, two-sided deposition also is possible. In this case, the improved hot-pressing property if provided on both sides.

The term "open thread structure" or "open fiber structure" is employed herein to define a thread distribution in which the threads reach distances between their contact points which are at least about 5 to 20-times as large as the diameter of the short fibers.

The subject of the present invention is explained in further detail with reference to the following examples:

EXAMPLE 1

A cross-laid carded fiber fabric of 50 g/m$^2$ of 100% polyethylene terephthalate fibers with a titer of 1.7 dtex and a cut length of 40 mm is impregnated with a bonding agent polymer dispersion of butylacrylate-acrylonitrile-N-methylolacrylamide, 90:4:6, so that there are 50 g/m$^2$ (dry) bonding agent in the finished material. The bonding agent dispersion contains 1% maleic acid and 4% of a dimethyl polysiloxane (by weight, referred to the weight of the polymer). Into the still wet impregnated fiber fabric, 10 g/m$^2$ short-cut fibers of nylon 66 with a titer of 1.7 dtex and a cut length of 0.75 mm are introduced in an electrostatic field. Subsequently, the fiber fabric is bound-in in a suitable drier and simultaneously, the bonding agent is dried and cross-linked.

Nonwoven fabric material of the same composition as above but without the flaked-on fiber prepared in a control test shows heavy sliding of the hot flatiron when ironed at 200° C., while the flatiron slides easily over the fabric with the fiber flakes. In addition, the fabric with the short fibers is more drapable, softer and fuller. It is suitable, for example, as a hobby fabric or as a table cover.

EXAMPLE 2

A nonwoven fabric as in Example 1 is prepared, but it is dried in an oven and condensed prior to the deposition of fibers. Subsequently, 8 g/m$^2$ of a thickened bonding agent dispersion of a polymerizate of butylacrylate-acrylonitrile-N-methylolacrylamide 90:4:6 are consecutively applied to both sides at a spacing of 25 mesh and taken into an electrostatic field in which 10 g/m$^2$ short-cut fibers with a titer of 1.7 dtex of polyethylene terephthalate and with a cut length of 0.75 mm are applied. In a drier, the flaked-on fiber is bound in and the bonding agent is dried and cross-linked. Subsequent cleaning via brush cylinders with suction removes the excess short fibers which are not bound-in. The properties and use of the nonwoven fabric, which in this case is deposited with fibers on both sides, is as described in Example 1.

EXAMPLE 3

A carded, lengthwise-oriented nonwoven fabric of 20 g/m$^2$ of 100% polyethylene terephtalate fibers with a titer of 1.7 dtex and a fiber length of 40 mm is prepressed between two cylinders at 170° C. and 10 g/m$^2$ thickened bonding agent (dry) of butylacrylate-acrylonitrile-N-methylolacrylamide polymerizate (90:6:4) with 1% maleic acid and 4% silicone is printed-on simultaneously on both sides in one operation at a 25 mesh spacing of the dots. The manner of application is described in German Offenlegungsschrift No. 29 14 617.

The still wet fabric is brought into an electrostatic field, in which 10 g/m$^2$ short fibers of nylon 6.6 with a titer of 1.7 dtex and a cut length of 0.75 mm are applied on one side. In the subsequent drier, the bonding agent which is used simultaneously for bonding the fabric and bonding the flaked-on fibers, is dried and cross-linked. A cleaning operation via brushing cylinders with suction removes the excess short fibers which have not been bound in the structure.

The nonwoven fabric with the flaked-on fibers on the flake side can be hot-pressed with a flatiron at 200° C., while the same flatiron slides only with difficulty on the fabric without fiber deposition. Otherwise, the nonwoven fabric with the fibers is again more drapable, softer and fuller.

What is claimed is:

1. A multilayer non-woven fabric having improved hot-press properties and a textile-like appearance, consisting essentially of a planar structure of several offset layers of natural and/or synthetic fibers, the fibers of each layer being coated either in whole or in part with a film of an elastic bonding agent and being joined together at their contacting points in the form of an open fiber structure and, protruding from the upper surface of each fiber layer in nap fashion, short fibers of equal length, each of which is bound to the body of one of said layer fibers only at the end face of said short fiber by means of said film; wherein the ratio of the length of the short fibers to the total thickness of the layered structure is about 2–7:1 and wherein the openings in the fiber structure of any layer have maximum diameters which are at least about 5–20 times as large as the diameters of the short fibers; and whereby said multilayered non-woven fabric is porous and exhibits a regular pattern of nap irregularities.

2. The nonwoven fabric according to claim 1 wherein said fibers are entirely or partially wrinkled.

3. The nonwoven fabric according to claim 1 wherein said bonding agent is one which is cross-linked by polymerization.

4. The nonwoven fabric according to claim 1 wherein said bonding agent is arranged in laminate fashion in the vicinity of the contacting fibers.

5. The nonwoven fabric according to claim 1 wherein said bonding agent and said short fibers are arranged in pattern-like areas in said fabric.

6. The nonwoven fabric according to claim 5 wherein said pattern-like areas are circular and wherein the mutual spacings between such areas is approximately equal to the diameter of said circular areas.

7. A method for imparting a textile-like appearance to a multilayered non-woven fabric and improving the hot-press properties thereof consisting essentially of:

(a) joining together artificial and/or natural fibers to form a planar structure having a non-woven open fiber structure;

(b) arranging said structures in several layers whereby the fibers of said layers are offset relative to each other;

(c) applying to said structures an elastic, cross-linkable bonding agent so as to completely or partially coat the fibers of said structure with a film of said bonding agent;

(d) applying short fibers of equal lengths in nap fashion to at least one side of said structure in an electrostatic field; and (e) thermally cross-linking and solidifying said bonding agent to bind each of said short fibers to the body of one of said natural and/or synthetic layer fibers only at end faces of said short fibers by means of said film; wherein the ratio of the length of the short fibers to the total thickness of the layered structure is about 2–7:1 and wherein the openings in the fiber structure of any layer have maximum diameters which are at least about 5–20 times as large as the diameters of the short fibers; and whereby said multilayered non-woven fabric is porous and exhibits a regular pattern of nap irregularities.

8. The method according to claim 7 wherein said planar structure of step (a) is presolidified prior to the impregnation or printing of step (b).

9. The method according to claim 8 wherein said presolidification is achieved by cementing and/or welding said fibers together.

10. The method according to claim 7 wherein heat-shrinkable or heat-expandable threads are embedded in said planar structure such that wrinkling of the planar structure is achieved during the heat treatment of step (d).

* * * * *